US011833640B2

(12) United States Patent
Iwakami et al.

(10) Patent No.: US 11,833,640 B2
(45) Date of Patent: Dec. 5, 2023

(54) ELECTRIC TOOL

(71) Applicant: MAKITA CORPORATION, Anjo (JP)

(72) Inventors: Junichi Iwakami, Anjo (JP); Hideharu Muto, Anjo (JP); Ryosuke Otani, Anjo (JP)

(73) Assignee: MAKITA CORPORATION, Anjo (JP)

( * ) Notice: Subject to any disclaimer, the term of this patent is extended or adjusted under 35 U.S.C. 154(b) by 0 days.

(21) Appl. No.: 17/955,140

(22) Filed: Sep. 28, 2022

(65) Prior Publication Data

US 2023/0021910 A1 Jan. 26, 2023

Related U.S. Application Data

(63) Continuation of application No. 16/468,508, filed as application No. PCT/JP2017/041658 on Nov. 20, 2017, now Pat. No. 11,484,986.

(30) Foreign Application Priority Data

Jan. 13, 2017 (JP) ..... 2017-004462
Jan. 13, 2017 (JP) ..... 2017-004463

(51) Int. Cl.

| | |
|---|---|
| ***B24B 47/00*** | (2006.01) |
| ***B24B 47/26*** | (2006.01) |
| ***B24B 23/02*** | (2006.01) |
| ***B24B 47/12*** | (2006.01) |
| *B25F 5/00* | (2006.01) |

(52) U.S. Cl.

CPC ..... *B24B 47/26* (2013.01); *B24B 23/02* (2013.01); *B24B 47/12* (2013.01); *B25F 5/008* (2013.01)

(58) Field of Classification Search

CPC ..... B24B 23/02; B24B 23/022; B24B 47/26; B24B 55/00

See application file for complete search history.

(56) References Cited

U.S. PATENT DOCUMENTS 2,924,915 A 2/1960 Rudnicki
4,793,064 A 12/1988 Nagashima et al.
(Continued)

FOREIGN PATENT DOCUMENTS

EP 2548698 A2 * 1/2013 ..... B23Q 11/0092
JP 2010-158755 A 7/2010
(Continued)

OTHER PUBLICATIONS

Jan. 23, 2018 Search Report issued in International Application No. PCT/JP2017/041658.
(Continued)

*Primary Examiner* — Eyamindae C Jallow
(74) *Attorney, Agent, or Firm* — Oliff PLC

(57) ABSTRACT

A grinder includes a brake mechanism, a switch lever, and a slide bar. In the grinder, an interlocking mechanism configured to interlock the brake mechanism with the switch lever includes a link member that is interposed between the switch lever and the slide bar, that moves the slide bar to the forward position at the push-in position of the switch lever, and that moves the slide bar to the retraction position at the initial position of the switch lever.

20 Claims, 11 Drawing Sheets

(56) References Cited

U.S. PATENT DOCUMENTS

| | | | | |
|---|---|---|---|---|
| 8,827,004 | B2 * | 9/2014 | Hosokawa | B27B 5/38 173/217 |
| 2005/0196273 | A1 * | 9/2005 | Nishikawa | H02K 9/06 415/206 |
| 2011/0203826 | A1 * | 8/2011 | Hosokawa | B24B 23/02 173/217 |
| 2013/0023189 | A1 | 1/2013 | Numata | |
| 2017/0304976 | A1 | 10/2017 | Nakamoto | |
| 2018/0147682 | A1 | 5/2018 | Duan | |
| 2019/0389020 | A1 | 12/2019 | Duernegger | |
| 2020/0266679 | A1 * | 8/2020 | Fujii | H01R 39/381 |
| 2021/0094147 | A1 * | 4/2021 | Ishikawa | B24B 23/005 |

FOREIGN PATENT DOCUMENTS

| | | | |
|---|---|---|---|
| JP | 2011-177812 | A | 9/2011 |
| JP | 5707267 | B2 | 4/2015 |
| JP | 2016-209956 | A | 12/2016 |

OTHER PUBLICATIONS

Jul. 16, 2019 International Preliminary Report on Patentability issued in International Patent Application No. PCT/JP2017/041658.
Mar. 2, 2021 Office Action issued in Japanese Patent Application No. 2017-004463.
Feb. 25, 2022 Office Action issued in Chinese Patent Application No. 201780083405.8.
Jul. 21, 2022 Notice of Allowance Issued in U.S. Appl. No. 16/468,508.

* cited by examiner

ELECTRIC TOOL

RELATED APPLICATIONS

This is a Continuation of U.S. patent application Ser. No. 16/468,508 filed Jun. 11, 2019, which claims the benefit of International Application No. PCT/JP2017/041658, filed on Nov. 20, 2017, Japanese Patent Application Number Nos. 2017-004462 filed on Jan. 13, 2017 and 2017-004463 filed on Jan. 13, 2017 and, the entirety of which is incorporated by reference.

BACKGROUND OF THE INVENTION

Field of the Invention

The present invention relates to an electric tool such as a grinder including a brake mechanism that brakes rotation of an output shaft of a motor, and an interlocking mechanism that interlocks the brake mechanism with a switch lever and turns the brake mechanism ON/OFF.

Description of Related Art

For example, Japanese Patent No. 5707267 discloses a grinder that includes a brake mechanism including a brake plate, a brake member, and a coil spring. The brake plate is fixed to an output shaft of a motor. The brake member is disposed opposite to and frontward of the brake plate and includes a brake shoe. The coil spring presses the brake member toward the brake plate side. In addition, the grinder is provided with an interlocking mechanism including a slide member. The slide member advances toward the brake member side in conjunction with a pushing operation (ON operation) on an operation member (switch lever) for turning ON/OFF a switch for driving the motor so as to separates the brake shoe from the brake plate.

Thus, by a pushing operation on the switch lever, the switch is turned ON and braking by the brake mechanism is released, so that the output shaft rotates. When the pushing operation is released, the switch is turned OFF and the brake mechanism operates, so that the output shaft is braked.

In the above conventional interlocking mechanism, the slide member is caused to advance and retract in a direction crossing the direction in which the switch lever, which is the operation member, is pushed. Therefore, it is necessary to assemble a rolling element to the slide member and assemble an inclined guide member, on which the rolling element rolls, to the switch lever. Thus, the number of components of the interlocking mechanism increases, leading to increase in cost, time, and effort for assembling. In addition, motion may be deteriorated due to dust or the like entering between components, and thus a pushing operation on the switch lever may become heavy or timing when the brake mechanism is turned ON/OFF may be delayed, so that the operability and the reliability of interlocking may be reduced.

Therefore, an object of the present invention is to provide an electric tool that can include an interlocking mechanism, which has a simple configuration with a small number of components and interlocks a brake mechanism with a switch lever, with good operability and reliability maintained.

In order to achieve the above object, the present invention is directed to an electric tool including:

a motor;

a housing containing the motor;

a brake mechanism provided frontward of the motor in the housing and including a brake member movable frontward and rearward between a brake position that is at a rear side and at which the brake member brakes an output shaft of the motor and a brake release position that is at a front side and at which braking of the output shaft is released;

a switch lever provided to the housing and movable between an initial position at which the switch lever projects from the housing and a push-in position at which the switch lever is pushed to the housing side and turns ON a switch, for driving the motor, provided in the housing;

a slide member provided in the housing and slidable between a forward position at which the slide member moves the brake member to the brake release position and a retraction position at which the slide member moves the brake member to the brake position; and an interlocking mechanism configured to interlock the brake mechanism with the switch lever, wherein the interlocking mechanism includes a link member that is interposed between the switch lever and the slide member, that moves the slide member to the forward position at the push-in position of the switch lever, and that moves the slide member to the retraction position at the initial position of the switch lever.

Here, the phrase "interposed between the switch lever and the slide member" indicates a technical meaning of the link member that indirectly transmits pressing force applied to the switch lever, to the slide member, and does not specify an arrangement in which the link member is located between the switch lever and the slide member.

Moreover, preferably, the link member has two arms projecting in different directions from a fulcrum and is rotatably supported, and, when one of the arms is pressed by the switch lever moving to the push-in position, the other of the arms presses the slide member to the forward position.

Moreover, the fulcrum is preferably supported at the housing side.

Moreover, preferably, the slide member is disposed between the switch lever and the link member, and the switch lever has a pair of left and right pressing portions for pressing the one of the arms, and the pair of left and right pressing portions interposes the slide member therebetween.

Moreover, the two arms of the link member preferably have different lengths.

Moreover, the link member is preferably a linear member having a front end rotatably connected to the slide member and a rear end held by the switch lever.

Moreover, the rear end of the link member is preferably connected to the switch lever by a shaft.

In order to achieve the above object, the present invention is directed to an electric tool including:

a motor;

a housing containing the motor;

a brake mechanism provided frontward of the motor in the housing and including a brake member movable between a brake position that is at a rear side and at which the brake member brakes an output shaft of the motor and a brake release position that is at a front side and at which braking of the output shaft is released; and a switch lever provided to the housing and movable between an initial position at which the switch lever projects from the housing and a push-in position at which the switch lever is pushed into the housing and turns ON a switch, for driving the motor, provided in the housing, wherein the brake member at the brake position and the switch lever at the initial position are integrally connected to each other, and the brake member is moved to the brake release position by pushing the switch lever to the push-in position.

Moreover, preferably, the brake member is supported in the housing such that the brake member can be swung about a swing fulcrum frontward and rearward, and the brake member is moved to the brake release position by being swung about the swing fulcrum frontward by pushing the switch lever.

Moreover, the brake member is preferably made of metal.

Moreover, preferably, the switch is disposed rearward of the switch lever, and a lever member is provided rearward of the switch lever and is configured to interlock with an operation on the switch lever, to turn the switch ON at the push-in position of the switch lever, and to turn the switch OFF at the initial position of the switch lever.

Moreover, the lever member preferably includes: a fulcrum portion that is rotatably supported rearward of a plunger provided to the switch; an effort point portion that is configured to interlock with an operation on the switch lever; and a load point portion that is provided between the fulcrum portion and the effort point portion and configured to press the plunger.

Moreover, the fulcrum portion is preferably provided at a rearmost portion of the housing.

Moreover, preferably, the housing includes a motor housing that contains the motor and extends rearward, and the fulcrum portion is provided at a rear portion of the motor housing.

According to the present invention, the interlocking mechanism, which interlocks the brake mechanism with the switch lever, can be formed with a simple structure having a small number of components, and cost, time, and effort for assembling can be reduced. In addition, a possibility of deterioration of motion due to entry of dust or the like is low. Thus, a pushing operation on the switch lever does not become heavy or timing of interlocking of the brake mechanism is not delayed, and good operability and reliability can be maintained.

Moreover, in addition to the above effect, the link member has two arms and is rotatably supported. The link member has a structure in which, when one of the arms is pressed by the switch lever moving to the push-in position, the other of the arms presses the slide member to the forward position. Therefore, the pressing force of the switch lever can be reasonably converted to frontward driving force of the slide member. In addition, the link member can be provided compactly in a smaller space.

Moreover, in addition to the above effects, a structure in which the fulcrum of the link member is supported at the housing side is formed. Therefore, the link member can also be easily assembled.

Moreover, in addition to the above effects, the slide member is disposed between the switch lever and the link member, and the switch lever has a pair of left and right pressing portions for pressing the one of the arms, and the pair of left and right pressing portions interposes the slide member therebetween. Therefore, the switch lever, the link member, and the slide member can be compactly disposed, and the link member can be assuredly rotated by the pressing portion even though the slide member is present between the switch lever and the link member.

Moreover, in addition to the above effects, the lengths of the two arms of the link member are made different from each other and the arm that is pressed by the switch lever is made longer than the arm that presses the slide member. Therefore, pressing force by the switch lever can be amplified and transmitted to the slide member, so that the pressing force required for the switch lever can be reduced and thus the operability can be improved further. On the other hand, when the arm that presses the slide member is made longer than the arm that is pressed by the switch lever, an amount of rotation of the link member can be efficiently converted to an amount of pressing of the slide member, so that a sufficient amount of sliding of the slide member can be obtained.

Moreover, in addition to the above effects, the link member is formed as a linear member having a front end rotatably connected to the slide member and a rear end held by the switch lever. Therefore, the configuration of the link member is simplified, and the link member can be easily assembled to the switch lever.

Moreover, in addition to the above effects, the rear end of the link member is connected to the switch lever by a shaft. Therefore, the link member can be inclined frontward with pushing of the switch lever, thereby efficiently pressing the switch lever frontward.

Moreover, in addition to the above effects, the brake member is supported in the housing such that the brake member can be swung about a swing fulcrum frontward and rearward and the brake member is configured to move to the brake release position by being swung about the swing fulcrum frontward by pushing the switch lever. Therefore, the brake member can be assuredly moved to the brake release position in conjunction with an operation on the switch lever.

Moreover, in addition to the above effects, the brake member is made of metal. Therefore, the rigidity of the brake member is enhanced and thus the durability and the reliability of the brake mechanism can be improved.

BRIEF DESCRIPTION OF THE DRAWINGS

FIG. 11A shows a switch OFF state, and FIG. 11B shows a switch ON state.

DETAILED DESCRIPTION OF THE INVENTION

Hereinafter, embodiments of the present invention will be described with reference to the drawings.

First, Embodiment 1 will be described below.

Figure 1:
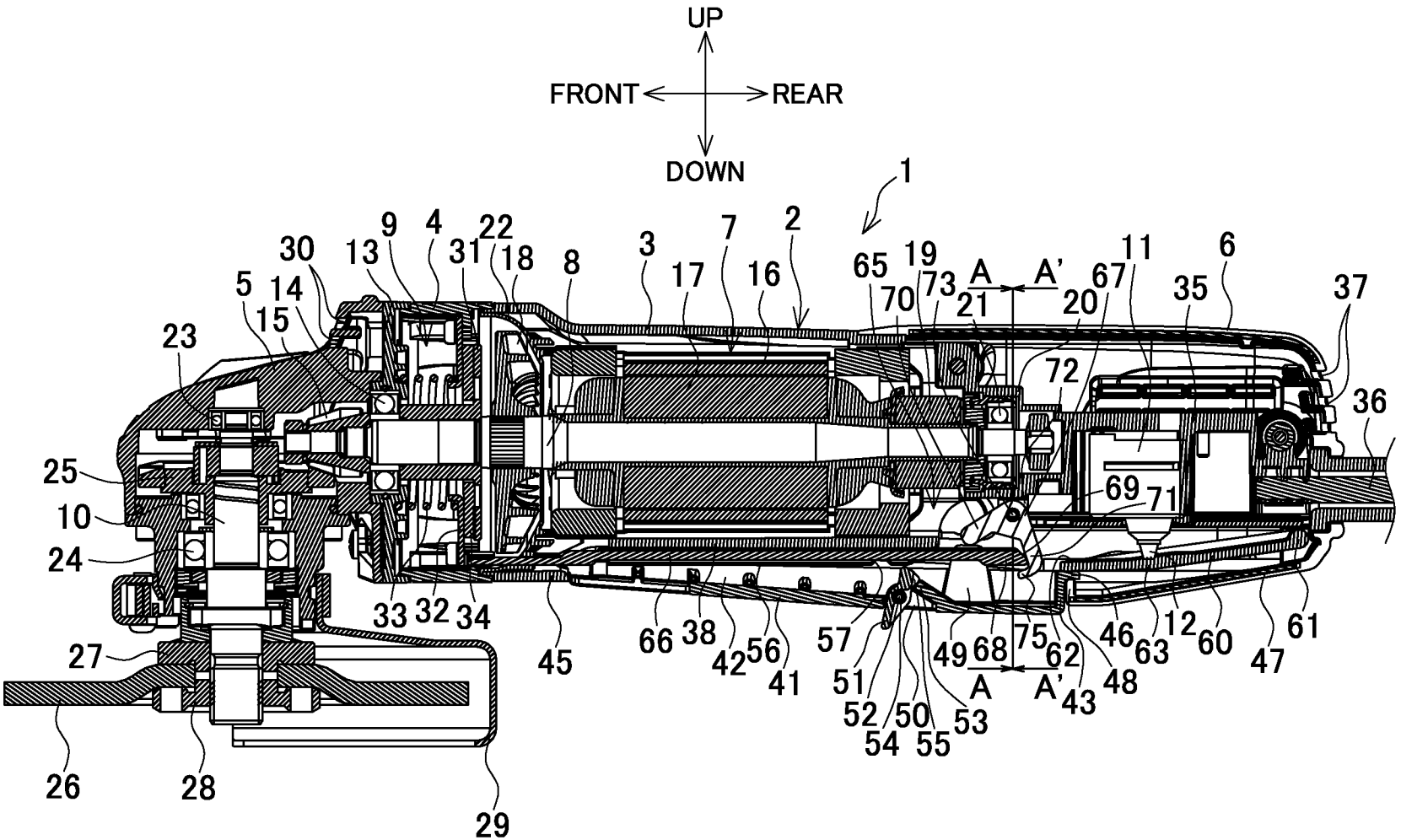
FIG. 1 is a central longitudinal cross-sectional view of a grinder of Embodiment 1 (a switch OFF state).

FIG. 1 is a central longitudinal cross-sectional view of a grinder that is an example of an electric tool. In the grinder 1, a housing 2 includes a motor housing 3, a brake holder 4, a gear housing 5, and a rear cover 6. The motor housing 3 contains a motor 7 and extends in a front-rear direction. The brake holder 4 is assembled to the front of the motor housing 3 and contains a brake mechanism 9. The gear housing 5 is assembled to the front of the brake holder 4 and from which a spindle 10 projects downward. The rear cover 6 is assembled to a rear portion of the motor housing 3 and contains a switch 11 provided with a plunger 12.

The motor 7 is a commutator motor including: a stator 16 that is held by the motor housing 3; and a rotor 17 that penetrates the stator 16 and has an axis along the output shaft 8. A motor cooling fan 18 is provided on the output shaft 8 at the front of the stator 16, and a commutator 19 is provided at a rear portion of the rotor 17. The rear end of the output shaft 8 is supported by a bearing 21 that is held by a holder portion 20 provided at the rear portion of the motor housing 3. A baffle plate 22 for sending air sent by the fan 18, toward the front side, is provided at a front-end opening of the motor housing 3 around the fan 18.

In the gear housing 5, the spindle 10 is supported via upper and lower bearings 23 and 24 so as to be orthogonal to the output shaft 8, and a second bevel gear 25 provided at the upper side of the spindle 10 is in mesh with the first bevel gear 15. A tip tool (here, a disk-shaped grindstone) 26 is attached to the lower end of the spindle 10, which projects from the gear housing 5, by an inner flange 27 and an outer flange 28 such that the tip tool 26 is detachable therefrom. A tool cover 29 for covering the rear half of the tip tool 26 from above is attached to a lower portion of the gear housing 5, and a plurality of air outlets 30, 30 are formed in the front surface of an upper portion of the gear housing 5.

The brake mechanism 9 includes a brake plate 31, a brake member 32, and a coil spring 33. The brake plate 31 is integrally fixed to the output shaft 8. The brake member 32 is penetrated by the output shaft 8 at the front of the brake plate 31 and is movable frontward/rearward. The coil spring 33 is penetrated by the output shaft 8 between the brake member 32 and the bearing plate 13 at the front of the brake member 32 and biases the brake member 32 rearward. The brake member 32 is made of metal and has a rear surface to which a brake shoe 34 is fixed. Thus, in a normal state, the brake member 32 is biased by the coil spring 33 to a brake position at which the brake shoe 34 is pressed against the brake plate 31 (an ON position of the brake mechanism 9).

Figure 2B:
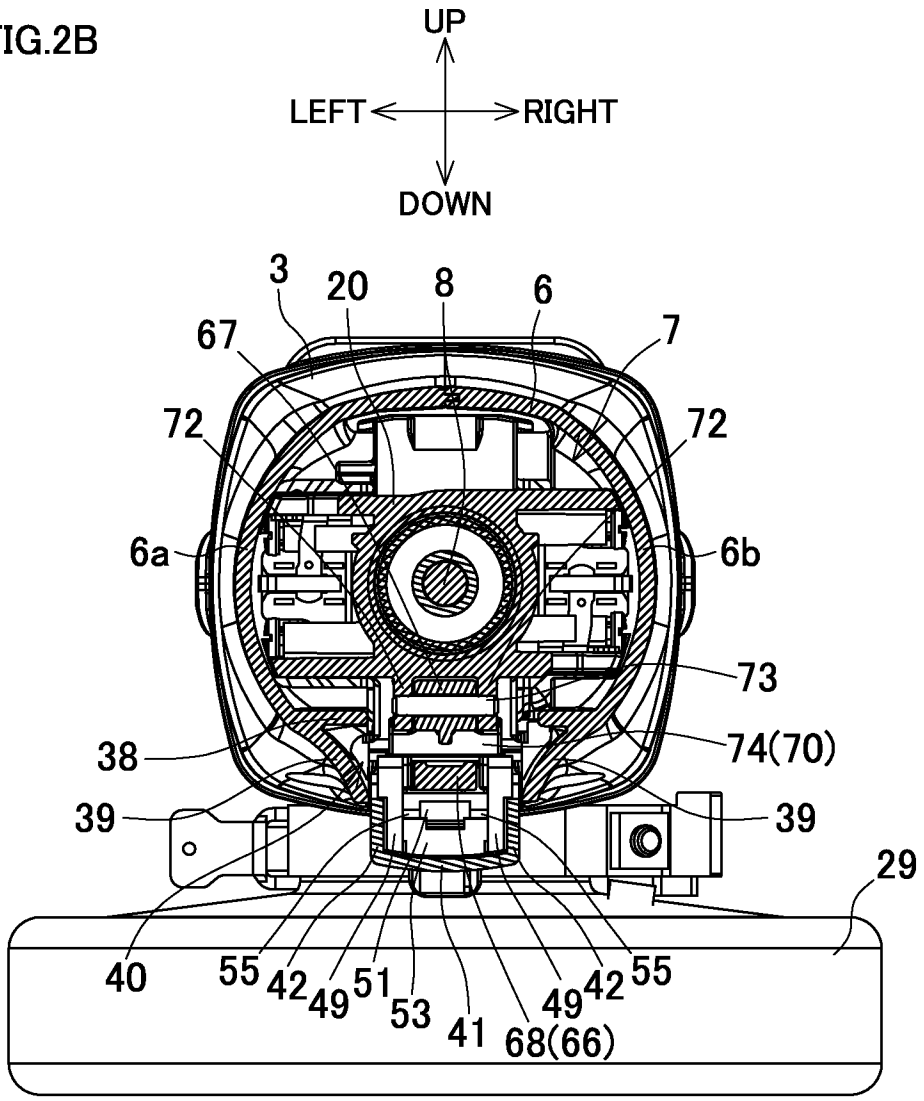
FIG. 2A shows a cross-section of FIG. 1 taken along a line A-A and FIG. 2B shows a cross-section of FIG. 1 taken along a line A'-A'.
Figure 2A:
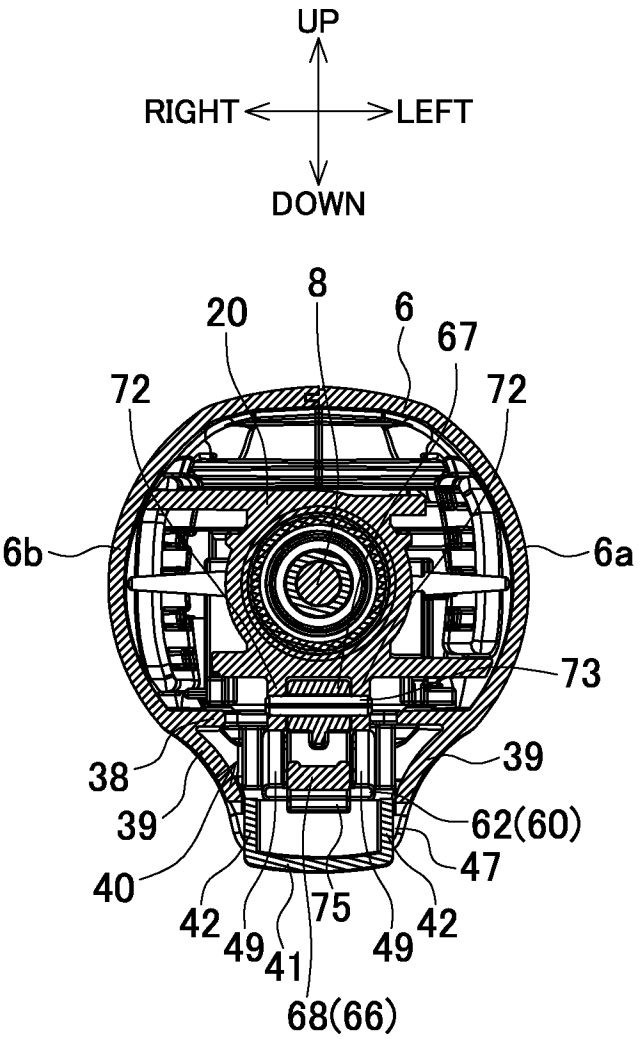

As shown in FIGS. 2A and 2B, the rear cover 6 is formed by fitting left and right half housings 6*a* and 6*b* to each other. The rear cover 6 has a cup shape that is open at the front thereof. The rear cover 6 is assembled to the rear portion of the motor housing 3 such that the holder portion 20 and a switch receiving portion 35 formed integrally at a rear portion of the holder portion 20 are contained in the rear cover 6. The switch receiving portion 35 has a quadrangular box shape that extends rearward in the rear cover 6 and is open at the lower surface thereof, and the switch 11 is held in such an attitude that the plunger 12 is projected and biased downward. The switch 11 performs an ON operation when the plunger 12 is pressed. A power cord 36 that penetrates the rear surface of the rear cover 6 and is extended rearward is connected to the rear end of the switch receiving portion 35, and a plurality of air inlets 37, 37 are formed in the rear surface of the rear cover 6 above the power cord 36.

Moreover, as shown in FIGS. 2A to 4, a bottom plate portion 38 and a pair of downward portions 39, 39 is formed on the lower surfaces of the motor housing 3 and the rear cover 6. The pair of downward portions 39, 39 projects downward from left and right portions of the bottom plate portion 38 in directions in which the downward portions 39, 39 come close to each other. Thus, a recess-shaped lever holding portion 40 that is open downward is formed over the lower surfaces of the motor housing 3 and the rear cover 6 in the front-rear direction.

A switch lever 41 for causing the switch 11 to perform an ON/OFF operation is provided at the lever holding portion 40. The switch lever 41 has a strip shape, in a planar view, extending in the front-rear direction along the opening of the lever holding portion 40. Side plates 42, 42 and a rear plate 43 are formed at the left and right ends and the rear end of the switch lever 41 so as to rise therefrom, and shaft portions 44, 44 are formed at the front end of the switch lever 41 so as to extend in the right-left direction. The shaft portions 44, 44 are held at the upper side of a stop plate 45 that projects rearward from the front end of the lower surface of the motor housing 3. A locking piece 46 is provided at the upper end of the rear plate 43 so as to project rearward.

Furthermore, a bulge portion 47 is formed at the lower surface side of the rear cover 6. The bulge portion 47 has a lateral width substantially equal to that of the switch lever 41, projects downward, bulges further downward while coming closer to the front side, and reaches the rear plate 43 of the switch lever 41. A contact portion 48 with which the locking piece 46 of the switch lever 41 comes into contact is formed at the front end of the bulge portion 47 so as to be bent upward.

Thus, the switch lever 41 is supported such that the switch lever 41 can be swung in the up-down direction about the shaft portions 44, and downward swing of the switch lever 41 is restricted at a position at which the locking piece 46 of the rear plate 43 comes into contact with the contact portion 48 of the rear cover 6. This position serves as an initial position at which the switch lever 41 projects downward from the opening of the lever holding portion 40, and an operation of pushing the switch lever 41 into the lever holding portion 40 can be performed from this position to a later-described push-in position.

Meanwhile, a pair of left and right pressing pieces 49, 49 for pressing a later-described link member 67 is provided on the upper surface of the switch lever 41 between the side plates 42, 42 at the front side of the rear plate 43 so as to project upward. An opening 50 is formed at the front of the pressing pieces 49, 49, and a lock-off button 51 is held in the opening 50. The lock-off button 51 is supported at an intermediate portion thereof in the opening 50 by a pin 52 extending in the right-left direction, and is rotatable between a standing attitude and a falling attitude. In the standing attitude, the lock-off button 51 comes into contact with a stopper portion 53, which rises obliquely frontward from the rear edge of the opening 50, and projects downward from the opening 50. In the falling attitude, the lock-off button 51 falls toward the front side in the opening 50 to be stored in the switch lever 41. In a normal state, the lock-off button 51 is rotationally biased to the standing attitude by a torsion spring 54 that is provided around the pin 52 and of which both ends are locked between the lock-off button 51 and the opening 50. A pair of triangular projection portions 55, 55 is formed on left and right portions of the upper end of the lock-off button 51 in the standing attitude so as to project rearward to come into contact with the stopper portion 53.

A pair of left and right guide walls 56, 56 is provided upright from the bottom plate portion 38, inside the left and right downward portions 39, 39 within the lever holding portion 40 at the motor housing 3 side, so as to extend in the front-rear direction. Triangular notches 57, 57 into which the projection portions 55, 55 of the lock-off button 51 in the falling attitude can be fitted are formed on the lower surfaces of rear portions of the guide walls 56, 56.

Thus, a pushing operation on the switch lever 41 can be performed from the initial position to the push-in position at which the projection portions 55, 55 of the lock-off button 51 in the falling attitude are fitted into the notches 57, 57 of the guide walls 56, 56.

The rear end of the switch lever 41 described here does not reach the plunger 12 of the switch 11 as shown in FIG. 1, and a lever member 60 is provided rearward of the switch lever 41. In the lever member 60, a shaft-shaped fulcrum portion 61 provided at the rear end of the lever member 60 and extending in the right-left direction is rotatably held at a rearmost portion within the bulge portion 47 of the rear cover 6 that is located below the plunger 12. An effort point portion 62 at the front end of the lever member 60 is a band-shaped plate extending to the upper side of the rear plate 43 of the switch lever 41. A load point portion 63 between the fulcrum portion 61 and the effort point portion 62 is in contact with the plunger 12 at a projected position. In this state, the lever member 60 is biased by the plunger 12 to a lower position at which the locking piece 46 of the switch lever 41 is locked to the contact portion 48 and the switch lever 41 is located at the initial position.

Figure 5:
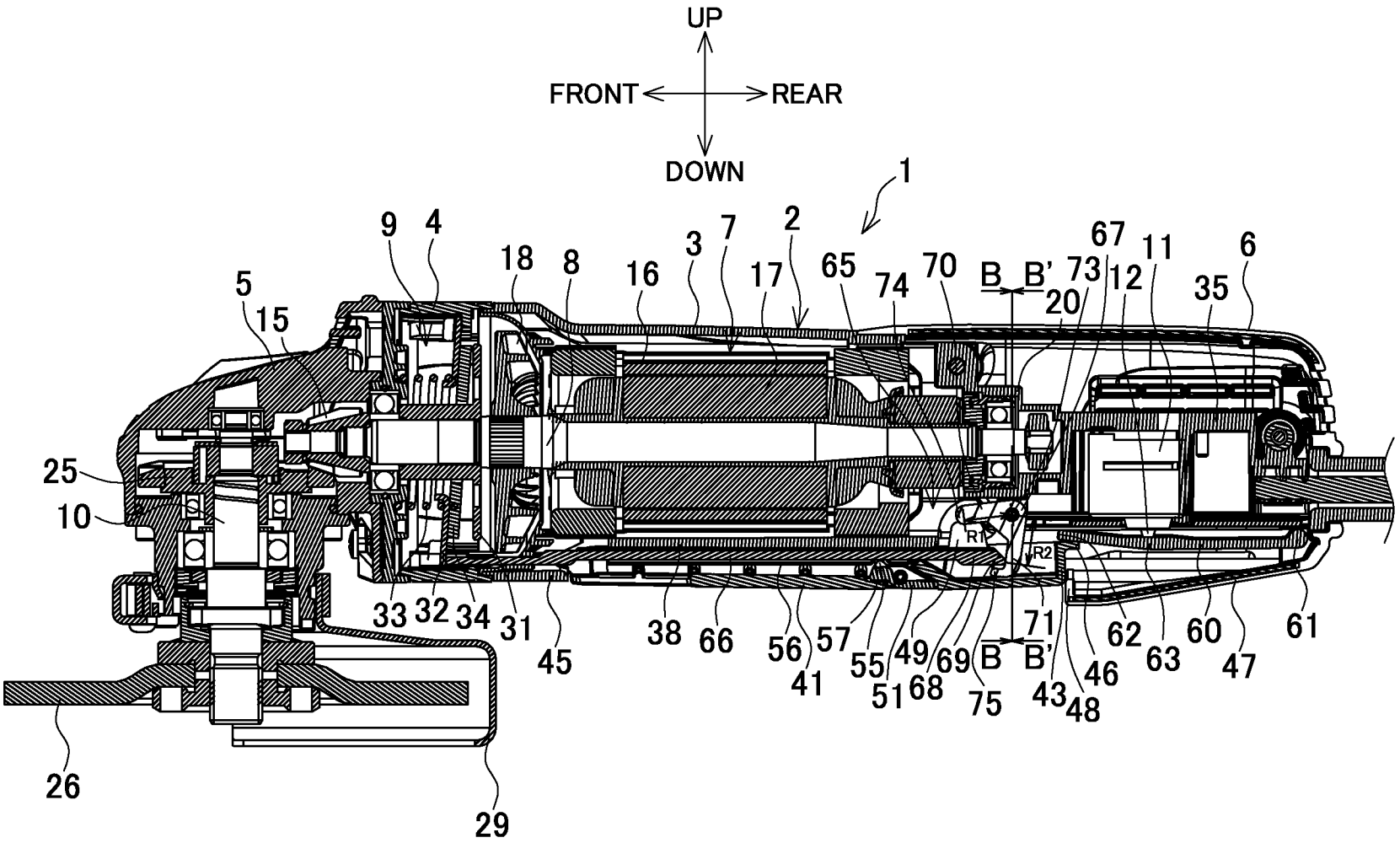
FIG. 5 is a central longitudinal cross-sectional view of the grinder of Embodiment 1 (a switch ON state).

Thus, when the switch lever 41 at the initial position is pushed to the push-in position, the rear plate 43 and the locking piece 46 push the effort point portion 62 of the lever member 60 upward as shown in FIG. 5, so that the lever member 60 can be swung about the fulcrum portion 61 to an upper position at which the load point portion 63 pushes the plunger 12 to cause the switch 11 to perform an ON operation. Here, the load point portion 63 is located between the fulcrum portion 61 and the effort point portion 62 of the lever member 60. Thus, the plunger 12 can be pushed via the lever member 60 even when the switch lever 41 is pushed by a force that is substantially half the motion load of the plunger 12.

An interlocking mechanism 65 that slides in conjunction with a pushing operation on the switch lever 41 and turns the brake mechanism 9 ON/OFF is provided at the upper side of the switch lever 41. The interlocking mechanism 65 includes a slide bar 66 and the link member 67. The slide bar 66 is provided in the lever holding portion 40 and the link member 67 is provided rearward of the slide bar 66.

Figure 3:
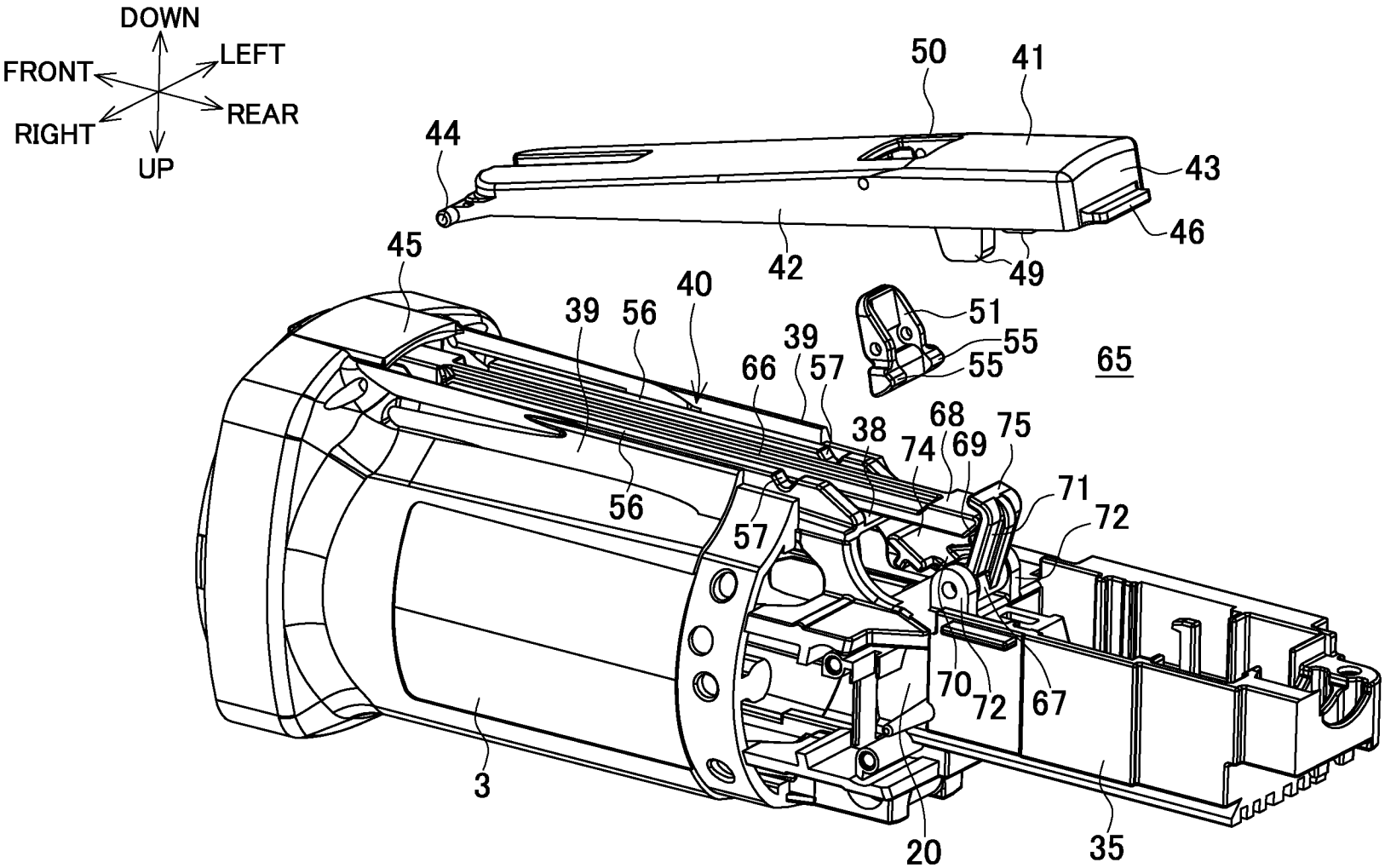
FIG. 3 is an exploded perspective view of a motor housing and a switch lever as seen from the rear side.
Figure 4:
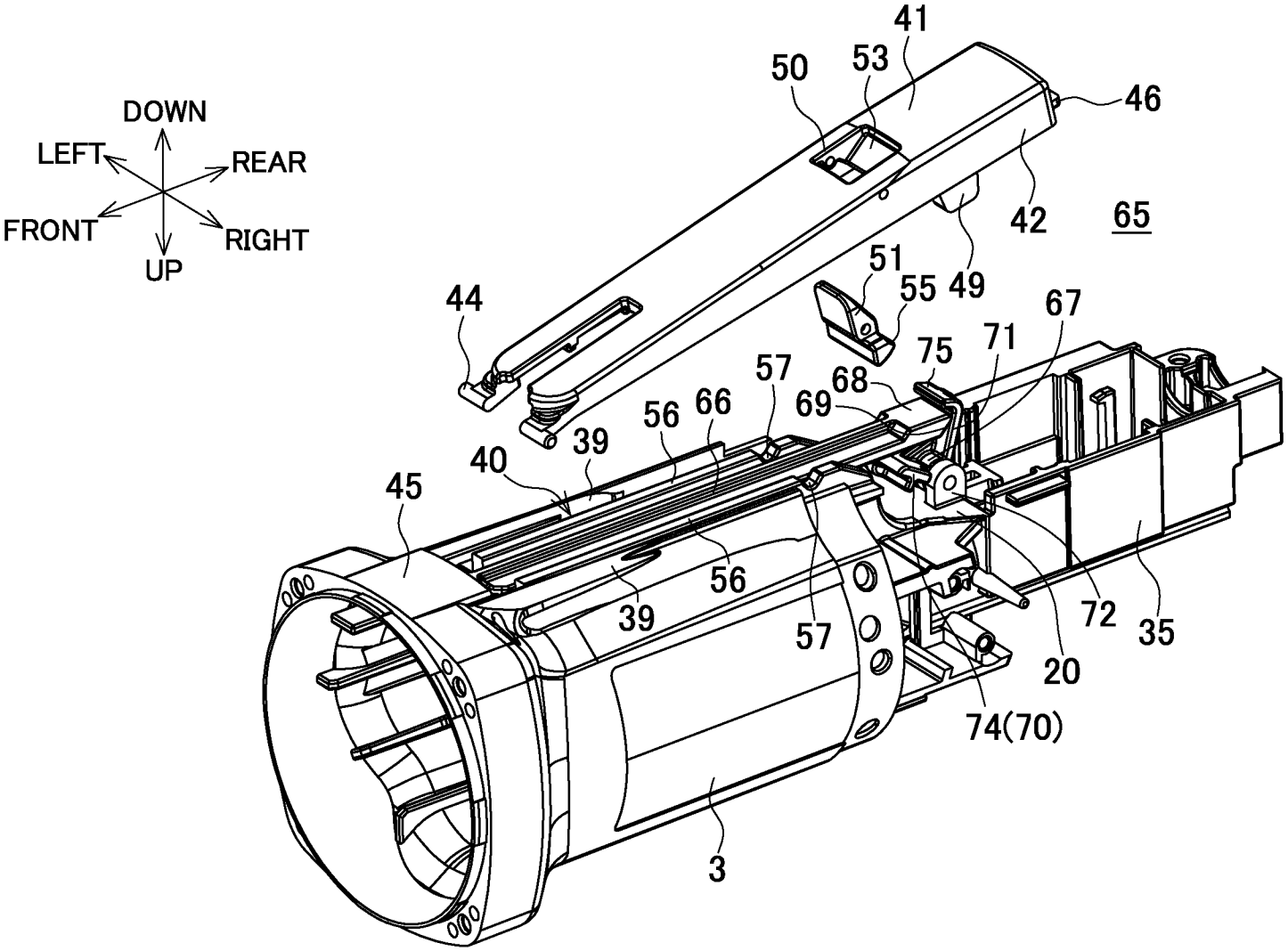
FIG. 4 is an exploded perspective view of the motor housing and the switch lever as seen from the front side.

First, as shown in FIGS. 3 and 4, the slide bar 66 is a plate-like member that is provided so as to be movable frontward and rearward along the lower surface of the bottom plate portion 38 between the guide walls 56, 56 and that has a width smaller than the interval between the pressing pieces 49, 49 of the switch lever 41. The slide bar 66 has a front end that projects frontward of the motor housing 3 and is close to the rear surface of the brake member 32 at a brake position. A thick portion 68 is formed at the rear end of the slide bar 66 so as to be thick at the lower side, and the rear surface of the thick portion 68 is an inclined surface 69 that is inclined rearward and downward.

The link member 67 is a plate-like member formed in an L shape, in a side view, having a front arm 70 and a rear arm 71 that project at both of the front and rear ends thereof at predetermined angles. The front and rear arms 70 and 71 are rotatably attached by a pin 73 between a pair of receiving projections 72, 72 that stands on left and right portions of the lower surface of the holder portion 20. In this state, the front arm 70 extends frontward above the slide bar 66 such that a wide portion 74 thereof having a larger lateral width than the slide bar 66 provided at the front end of the front arm 70 is located at the upper side of the pressing pieces 49, 49. The rear arm 71 extends rearward at the rear side of the thick portion 68 of the slide bar 66, and has a bent piece 75 formed at the front end thereof so as to be bent frontward and to extend around to the lower side of the inclined surface 69 of the thick portion 68.

Thus, in the interlocking mechanism 65, when the switch lever 41 is located at the initial position, the left and right pressing pieces 49, 49 slightly project upward at the top ends thereof such that the slide bar 66 is laterally interposed therebetween. At this time, the slide bar 66 is located at a retraction position at which the front end thereof is close to the brake member 32 at the brake position, and the lower edge of the inclined surface 69 of the thick portion 68 at the rear end of the slide bar 66 is brought into contact with the rear arm 71 of the link member 67 at the upper side of the bent piece 75. Thus, as shown in FIGS. 1, 2A and 2B, the link member 67 is biased to a first rotation position at which the wide portion 74 of the front arm 70 comes into contact with the top ends of the pressing pieces 49, 49.

Figure 6B:
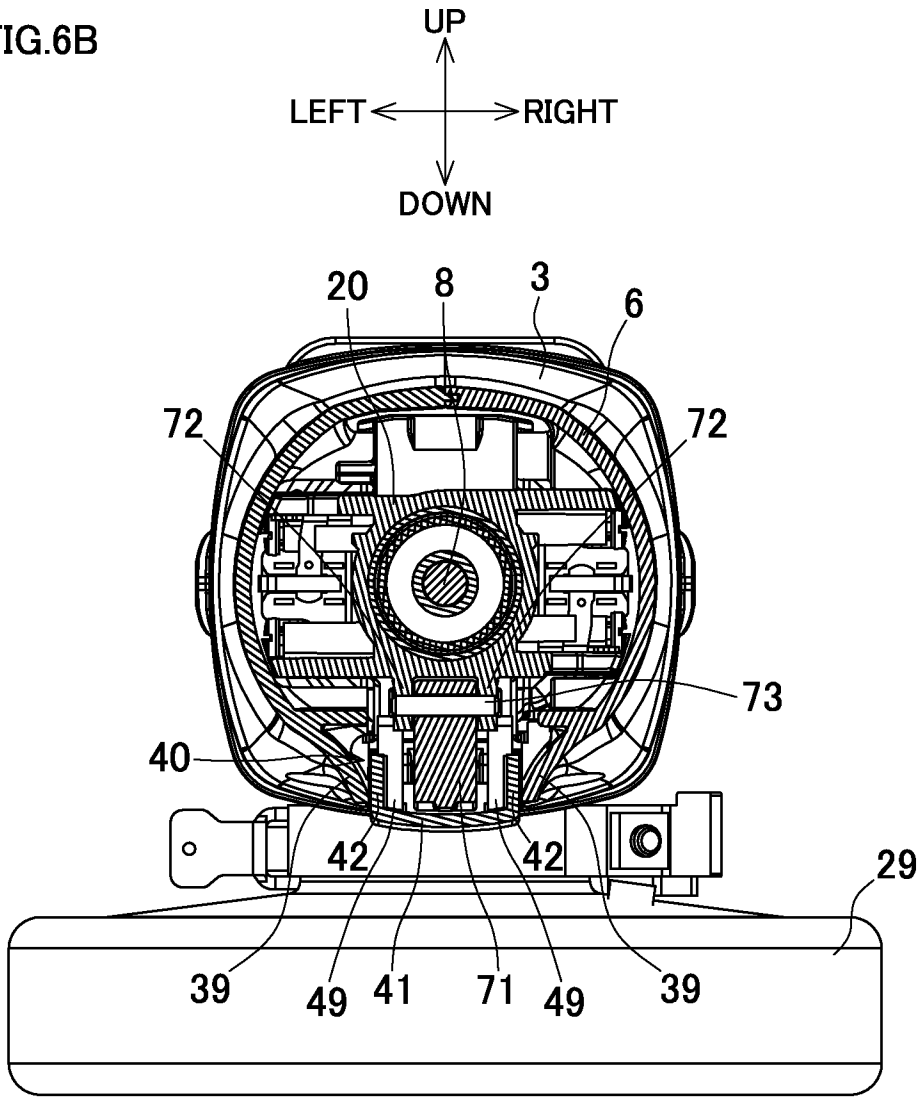
FIG. 6A shows a cross-section of FIG. 5 taken along a line B-B and FIG. 6B shows a cross-section of FIG. 5 taken along a line B'-B'.
Figure 6A:
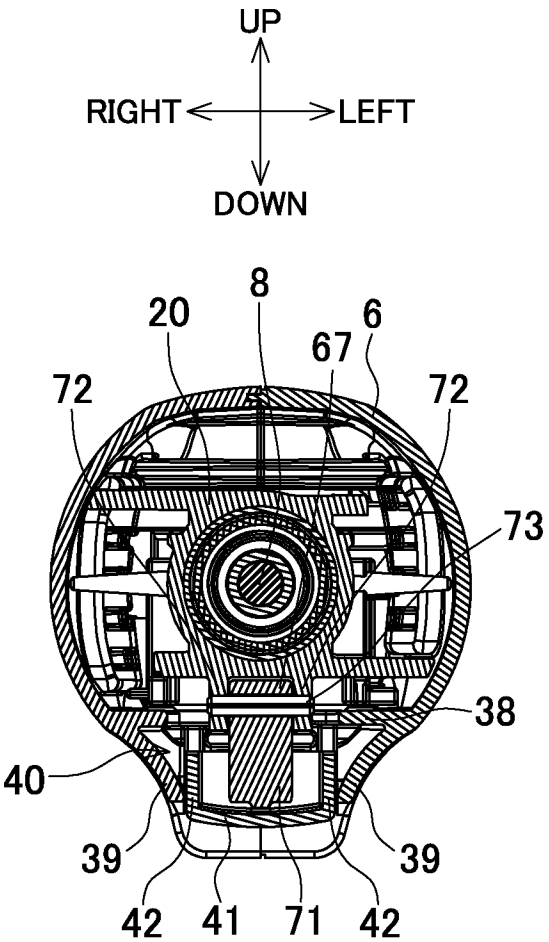

In this state, when the switch lever 41 is pushed to the push-in position, the left and right pressing pieces 49, 49 move upward and press the front arm 70 of the link member 67 upward, and thus the link member 67 rotates rightward in FIG. 1 to a second rotation position at which the rear arm 71 moves frontward as shown in FIGS. 5, 6A and 6B. At this second rotation position, the rear arm 71 slides the slide bar 66 frontward and pushes the lower end of the brake member 32 frontward against the bias of the coil spring 33. At this forward position, the brake member 32 is moved to a brake release position at which the brake shoe 34 is separated from the brake plate 31.

Here, the inclined surface 69 is formed at the rear end of the thick portion 68, a long distance is ensured between the center of the pin 73 and the position at which the lower edge of the inclined surface 69 is in contact with the rear arm 71, and a distance R2 from the center of the pin 73 to the position of contact between the rear arm 71 and the lower edge of the inclined surface 69 is set so as to be slightly longer than a distance R1 from the center of the pin 73 to the position of contact between the wide portion 74 of the front arm 70 and the pressing pieces 49, 49. Thus, an amount of rotation of the link member 67 by motion of the front arm 70 can be efficiently converted to an amount of pressing of the slide bar 66 by the rear arm 71, so that a sufficient amount of sliding of the slide bar 66 can be obtained.

Moreover, when the rear arm 71 presses the slide bar 66, the bent piece 75 at the front end of the rear arm 71 extends around to the lower side of the lower edge of the inclined surface 69. Therefore, the rear arm 71 can be assuredly locked to the inclined surface 69 and press the thick portion 68.

In the grinder 1 configured as described above, in the OFF state of the switch 11 in FIGS. 1, 2A and 2B, the lever member 60 is located at the lower position at which the lever member 60 does not push the plunger 12, and the switch lever 41 is also located at the initial position. Thus, the link member 67 is also located at the first rotation position, and the slide bar 66 is located at the retraction position, whereby the brake member 32 is held at the brake position at which the brake member 32 presses the brake shoe 34 against the brake plate 31. In addition, the lock-off button 51 shifts to the standing attitude at which the lock-off button 51 comes into contact with the stopper portion 53, and is in contact with the lower surfaces of the guide walls 56, 56, so that pushing of the switch lever 41 is restricted by the lock-off button 51.

In this state, when the lower end of the lock-off button 51 is rotated rearward using a finger holding the motor housing 3, which serves as a grip, to bring the lock-off button 51 into the falling attitude, the restriction of pushing of the switch lever 41 is released. Thus, the switch lever 41 can be pushed to the push-in position at which the projection portions 55, 55 fit into the notches 57, 57 of the guide walls 56, 56. Accordingly, as shown in FIGS. 5, 6A and 6B, the pressing pieces 49, 49 push upward the front arm 70 of the link member 67 and rotate the link member 67 to the second rotation position, and the slide bar 66 is slid to the forward position by the rear arm 71, whereby the brake shoe 34 of the brake member 32 is separated from the brake plate 31 and the braking is released. At the same time, the lever member 60 swings to the upper position and pushes the plunger 12, thereby turning the switch 11 ON. Thus, current is applied to the motor 7 and the output shaft 8 for which the braking has been released rotates and causes the spindle 10 to rotate via the first and second bevel gears 15 and 25, thereby enabling polishing work or the like by the tip tool 26 rotating together with the spindle 10.

Moreover, when the fan 18 rotates with the rotation of the output shaft 8, outside air is introduced through the air inlets 37 at the rear end of the rear cover 6 and passes through the interior of the motor housing 3 to cool the motor 7. Then, the outside air passes through the brake holder 4 and is discharged through the air outlets 30 of the gear housing 5.

Meanwhile, when the pushing of the switch lever 41 is released, the lever member 60 returns to the lower position and releases the pushing of the plunger 12 to turn the switch 11 OFF, thereby stopping the application of the current to the motor 7, and the switch lever 41 is returned to the initial position. At the same time, the brake member 32 returns to the brake position due to the bias of the coil spring 33 and presses the brake shoe 34 against the brake plate 31 to brake the rotation of the output shaft 8. In addition, the slide bar 66 is slid to the retraction position, the rear arm 71 is pushed rearward, and the link member 67 is returned to the first rotation position.

As described above, in the grinder 1 of Embodiment 1 described above, the interlocking mechanism 65, which interlocks the brake mechanism 9 with the switch lever 41, includes the link member 67 that is interposed between the switch lever 41 and the slide bar 66, that moves the slide bar 66 to the forward position at the push-in position of the switch lever 41, and that moves the slide bar 66 to the retraction position at the initial position of the switch lever 41. Thus, the slide bar 66 can be interlocked with an operation on the switch lever 41 only by the link member 67. Accordingly, the interlocking mechanism 65 can be formed with a simple structure having a small number of components, and cost, time, and effort for assembling can be reduced. In addition, a possibility of deterioration of motion due to entry of dust or the like is low. Thus, a pushing operation on the switch lever 41 does not become heavy or timing of interlocking of the brake mechanism 9 is not delayed, and good operability and reliability can be maintained.

In particular, the link member 67 is formed as a rotary member that is rotatably supported and that has the two front and rear arms 70, 71 projecting in different directions from the pin 73. Further, the link member 67 has a structure in which the rear arm 71 presses the slide bar 66 to the forward position when the front arm 70 is pressed by the switch lever 41 moving to the push-in position. Thus, the pressing force of the switch lever 41 from the lower side can be reasonably converted to frontward driving force of the slide bar 66. In addition, the link member 67 can be provided compactly in a smaller space.

Moreover, since the pin 73 is supported at the housing 2 side, the link member 67 can be easily assembled.

Furthermore, the slide bar 66 is disposed between the switch lever 41 and the link member 67, and the pair of left and right pressing pieces 49, 49 of the switch lever 41 is provided so as to interpose the slide bar 66 therebetween. Thus, the switch lever 41, the link member 67, and the slide bar 66 can be compactly disposed. Further, the link member 67 can be assuredly rotated by the pressing pieces 49, 49 even though the slide bar 66 is present between the switch lever 41 and the link member 67.

Moreover, in the link member 67, the rear arm 71 is made longer than the front arm 70. Thus, an amount of rotation of the link member 67 by motion of the front arm 70 can be efficiently converted to an amount of pressing of the slide bar 66 by the rear arm 71, so that a sufficient amount of sliding of the slide bar 66 can be obtained.

Since pressing force by the switch lever 41 can be amplified and transmitted to the slide bar 66, the pressing force required for the switch lever 41 can be reduced and thus the operability can be improved further.

Since the brake member 32 is made of metal, the rigidity of the brake member 32 is enhanced and thus the durability and the reliability of the brake mechanism 9 can be improved.

In the grinder 1 of Embodiment 1 described above, the switch 11 is disposed rearward of the switch lever 41, and the lever member 60, which is interlocked with an operation on the switch lever 41, which turns the switch 11 ON at the push-in position of the switch lever 41, and which turns the switch 11 OFF at the initial position of the switch lever 41, is provided rearward of the switch lever 41. Thus, a pushing operation on the switch lever 41 can be performed with a load smaller than the motion load of the switch 11. In addition, even when the switch 11 is disposed rearward of the switch lever 41, it is not necessary to dispose the switch lever 41 below the switch 11. Thus, the position at which the housing 2 is held for operating the switch lever 41 can be maintained at the front side, so that the operability becomes good and the flexibility in design is also increased. Furthermore, the air inlets 37 for motor cooling are not closed by a hand holding the housing 2, and thus there is no possibility of reduction in cooling function.

In particular, the lever member 60 includes the fulcrum portion 61, the effort point portion 62, and the load point portion 63. The fulcrum portion 61 is rotatably supported rearward of the plunger 12 provided to the switch 11, the effort point portion 62 interlocks with an operation on the switch lever 41, and the load point portion 63 is located between the fulcrum portion 61 and the effort point portion 62 and presses the plunger 12. Thus, even when the switch lever 41 is pushed with force that is substantially half the motion load of the plunger 12, the plunger 12 can be pushed via the lever member 60.

Moreover, the fulcrum portion 61 is provided at the rearmost portion of the housing 2. Thus, the inclination angle of the lever member 60 toward the lower side at the initial position is reduced, and the amount by which the lever member 60 projects below the housing 2 can be reduced even when the lever member 60 is provided.

Furthermore, the brake member 32, which is movable between the brake position at which the output shaft 8 of the motor 7 is braked at the initial position of the switch lever 41 and the brake release position at which the braking of the output shaft 8 is released at the push-in position of the switch lever 41, is provided in the housing 2. Thus, an operation load on the switch lever 41, with which the brake member 32 is interlocked, can be effectively reduced.

In Embodiment 1 described above, the link member is provided at the motor housing side, and the pressing pieces are provided to the switch lever. In contrast to this, the link member may be attached by a shaft inside the switch lever in an attitude in which the front and rear arms are open at the motor housing side, and the pressing pieces may be provided upright at the motor housing side. In this case as well, by pushing the switch lever, the pressing pieces can be pressed against the front arm of the link member across the slide bar to rotate the link member, and the slide bar can be pushed frontward by the rear arm.

Moreover, in Embodiment 1 described above, a structure in which the front and rear arms of the link member are brought into contact with the pressing pieces and the slide bar, respectively, is formed. However, the pressing pieces and the front arm may be rotatably connected by a pin or the like, or the rear end of the slide bar and the rear arm may be rotatably connected by a pin or the like.

Furthermore, in contrast to Embodiment 1 described above, in the link member, the front arm, which is pressed by the switch lever, may be made longer than the rear arm, which presses the slide bar. When the lengths of the arms are made different from each other as described above, pressing force by the switch lever can be amplified and transmitted to the slide bar, so that the pressing force required for the switch lever can be reduced and thus the operability can be improved further. As a matter of course, the lengths of the two arms do not have to be different from each other and may be equal to each other.

Next, other embodiments of the present invention will be described. It should be noted that components that are the same as those in Embodiment 1 are designated by the same reference characters and the overlapping description thereof is omitted.

First, Embodiment 2 will be described.

Figure 7:
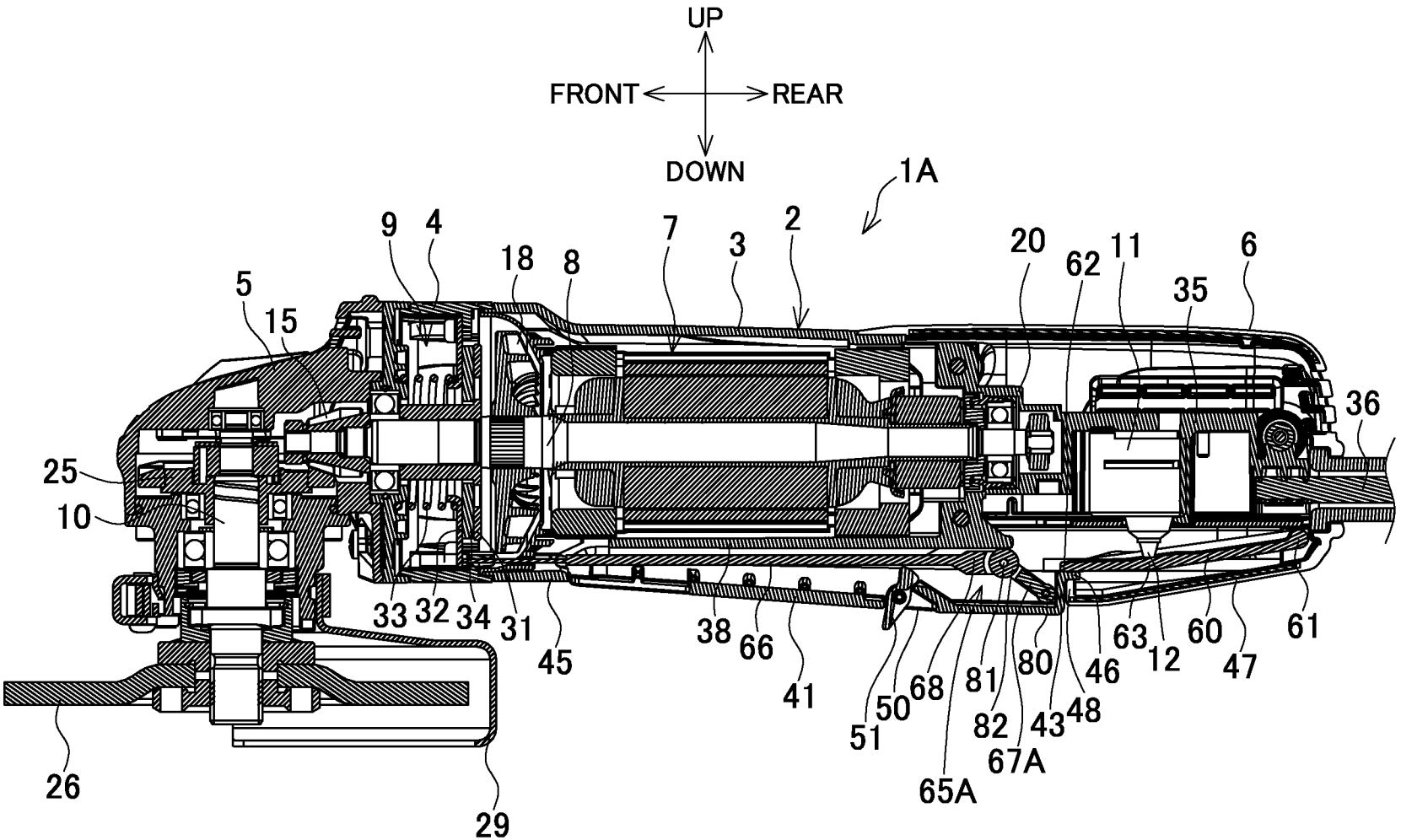
FIG. 7 is a central longitudinal cross-sectional view of a grinder of Embodiment 2 (a switch OFF state).

In a grinder 1A shown in FIG. 7, in an interlocking mechanism 65A, a link member 67A is provided in a rear end portion of the switch lever 41. The link member 67A does not have an L shape, but is a linear plate. The link member 67A has a rear end rotatably attached to a front lower portion of the rear plate 43 of the switch lever 41 by a rear pin 80 extending in the right-left direction, and has a front end rotatably attached to the thick portion 68 of the slide bar 66 by a front pin 81. The front end of the link member 67A is formed so as to branch into two portions, and a roller 82 having a diameter larger than the thickness of the thick portion 68 in the up-down direction is attached between the two portions by the front pin 81. It should be noted that no pressing piece is provided to the motor housing 3.

In the interlocking mechanism 65A, at the initial position of the switch lever 41, as shown in FIG. 7, with respect to the slide bar 66 at the retraction position, the link member 67A shifts to an inclination attitude in which the link member 67A rises obliquely frontward from the front lower portion of the rear plate 43 of the switch lever 41, thereby bringing the roller 82 into contact with the bottom plate portion 38.

Figure 8:
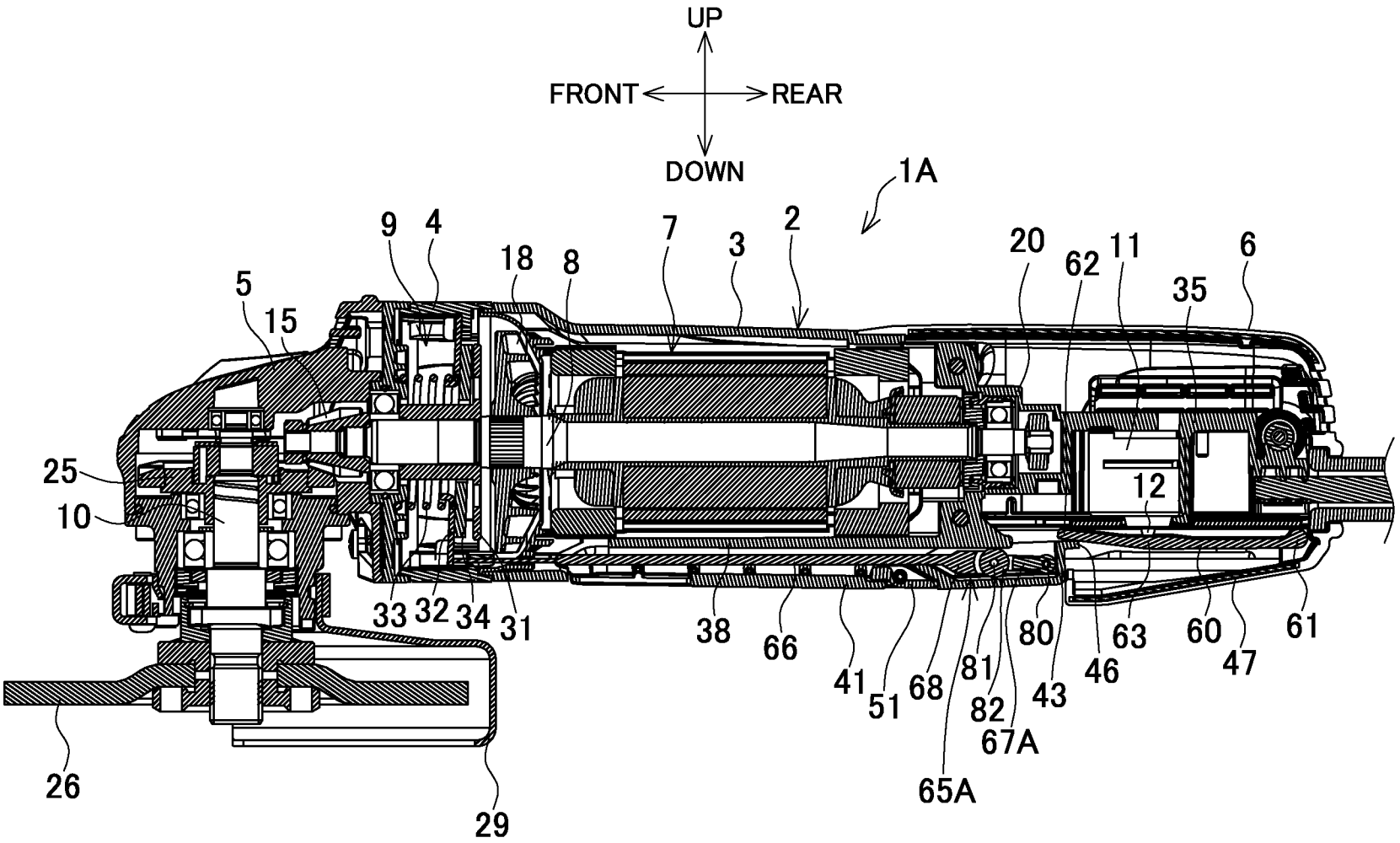
FIG. 8 is a central longitudinal cross-sectional view of the grinder of Embodiment 2 (a switch ON state).

In this state, when the switch lever 41 is pushed to the push-in position, the link member 67A falls toward the front side within the switch lever 41 to form a linear shape together with the slide bar 66 while causing the roller 82 to roll frontward, as shown in FIG. 8. Thus, the slide bar 66 is pressed by the link member 67A and slides to the forward position, whereby the brake member 32 can be pushed and the braking can be released. When the pushing of the switch lever 41 is released, the slide bar 66 is slid to the retraction position by the brake member 32 returning to the brake position due to the bias of the coil spring 33, and the link member 67A is returned to the inclination attitude in FIG. 7. Motion of the lever member 60 is the same as in Embodiment 1.

As described above, also in the grinder 1A of Embodiment 2 described above, the interlocking mechanism 65A, which interlocks the brake mechanism 9 with the switch lever 41, includes the link member 67A that is interposed between the switch lever 41 and the slide bar 66, that moves the slide bar 66 to the forward position at the push-in position of the switch lever 41, and that moves the slide bar 66 to the retraction position at the initial position of the switch lever 41. Thus, the slide bar 66 can be interlocked with an operation on the switch lever 41 only by the link member 67A. Accordingly, the interlocking mechanism 65A can be formed with a simple structure having a small number of components, and cost, time, and effort for assembling can be reduced. In addition, a possibility of deterioration of motion due to entry of dust or the like is low. Thus, a pushing operation on the switch lever 41 does not become heavy or timing of interlocking of the brake mechanism 9 is not delayed, and good operability and reliability can be maintained.

In particular, the link member 67A is formed as a linear member having a front end rotatably connected to the slide bar 66 and a rear end held by the switch lever 41. Thus, the configuration of the link member 67A is simplified, and the link member 67A can be easily assembled to the switch lever 41.

Moreover, the rear end of the link member 67A is connected to the switch lever 41 by the rear pin 80. Thus, the link member 67A can be inclined frontward with pushing of the switch lever 41, thereby efficiently pressing the switch lever 41 frontward.

It should be noted that, in Embodiment 2 described above, the roller is provided at the portion where the slide bar and the link member are connected to each other, but the roller may be omitted. In addition, the rear end of the link member is connected by the rear pin, but the rear end of the link member may be fitted and held in a recess provided on the inner surface of the switch lever, and not attached by a shaft as described above.

Next, Embodiment 3 will be described.

Figure 9:
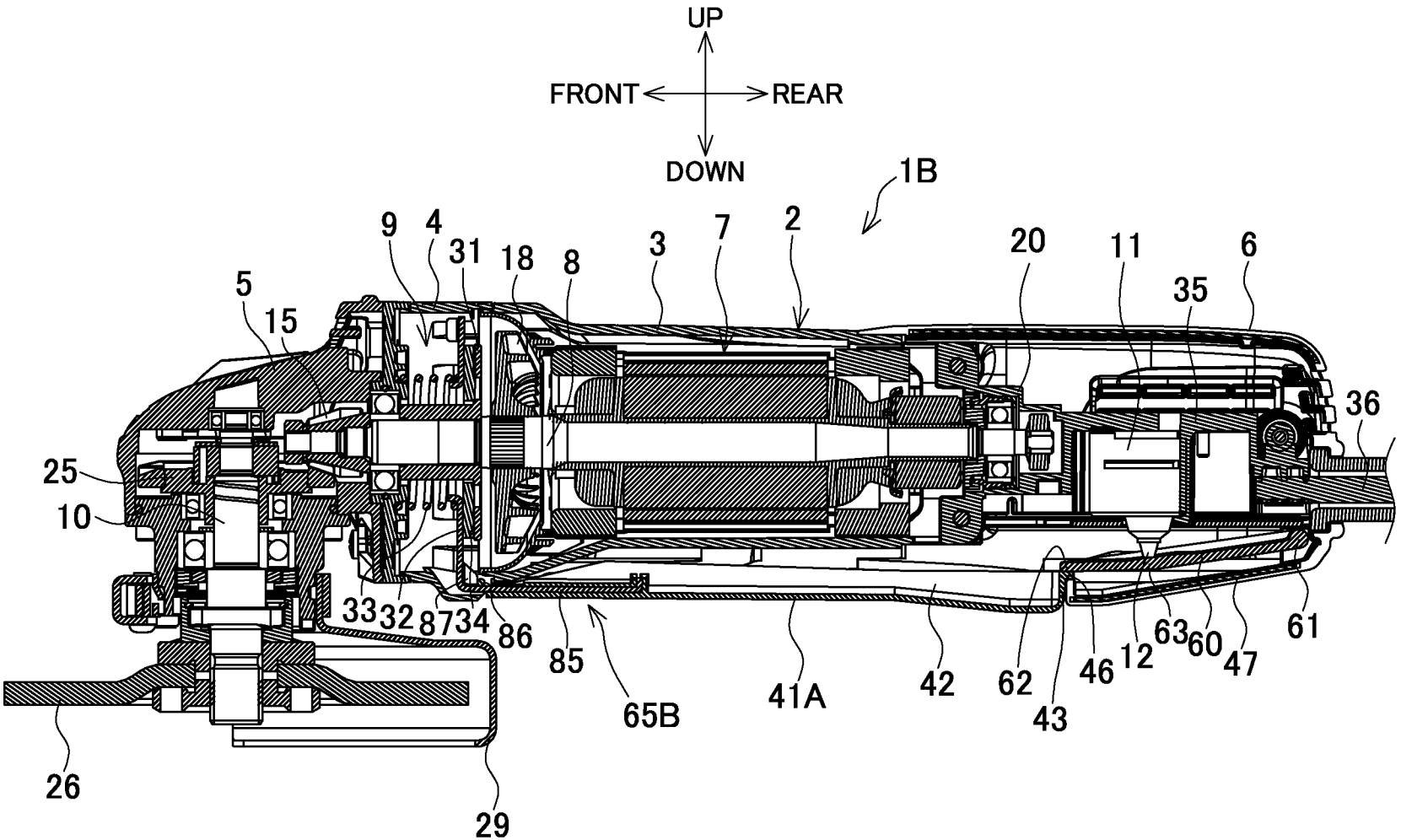
FIG. 9 is a central longitudinal cross-sectional view of a grinder of Embodiment 3 (a switch OFF state).

In a grinder 1B shown in FIG. 9, in an interlocking mechanism 65B, a link member and a slide bar are not provided. In a grinder 1B, a connection plate 85 is integrally formed at the lower end of the brake member 32 so as to be perpendicular thereto and to extend rearward, and a fulcrum pin 86 fixed to the upper side of a front portion of the connection plate 85 and extending in the right-left direction is rotatably supported on the brake holder 4. The front end of a switch lever 41A that does not have a shaft portion and a lock-off button is fixed to the lower side of the connection plate 85 at the rear side of the fulcrum pin 86. A rib 87 that maintains the angle between the brake member 32 and the connection plate 85 is provided between the brake member 32 and the connection plate 85 at the front side of the fulcrum pin 86.

In the interlocking mechanism 65B, similar to Embodiments 1 and 2, the switch lever 41A is biased to an initial position by the lever member 60, which is biased to the lower position by the plunger 12, as shown in FIG. 9. Here, the connection plate 85 extending rearward from the brake member 32, which is biased to the brake position by the coil spring 33, also contributes to holding the switch lever 41A at the initial position.

Figure 10:
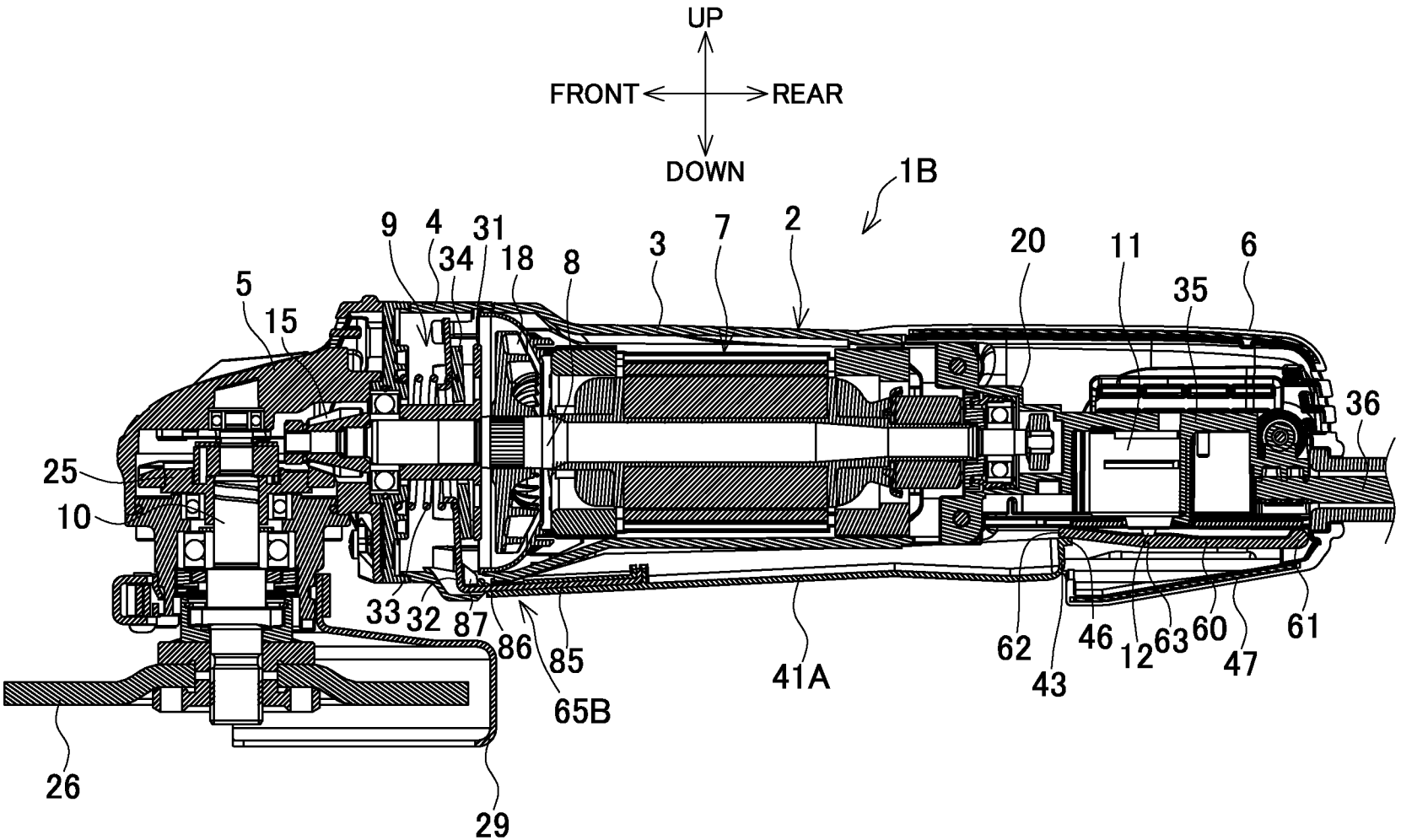
FIG. 10 is a central longitudinal cross-sectional view of the grinder of Embodiment 3 (a switch ON state).

In this state, when the switch lever 41A is pushed to a push-in position, the connection plate 85 and the brake member 32 rotate leftward about the fulcrum pin 86 with upward swing of a front end portion of the switch lever 41A as shown in FIG. 10. Thus, the brake member 32 can be moved to the brake release position at which the brake shoe 34 is separated from the brake plate 31. When the pushing of the switch lever 41A is released, the brake member 32 returns to the brake position due to the bias of the coil spring 33, and the switch lever 41A integrated with the brake member 32 is returned to the initial position. Motion of the lever member 60 is the same as in Embodiment 1.

As described above, also in the grinder 1B of Embodiment 3 described above, the brake member 32 at the brake position and the switch lever 41A at the initial position are integrally connected to each other, and the brake member 32 is configured to move to the brake release position by pushing the switch lever 41A to the push-in position. Thus, the brake member 32 can be directly interlocked with an operation on the switch lever 41A. Accordingly, the interlocking mechanism 65B can be formed with a simple structure having a small number of components, and cost, time, and effort for assembling can also be reduced. In addition, a possibility of deterioration of motion due to entry of dust or the like is low, and thus good operability and reliability can be maintained.

In particular, the brake member 32 is supported in the housing 2 such that the brake member 32 can be swung about the fulcrum pin 86 frontward and rearward, and the brake member 32 is moved to the brake release position by being swung about the fulcrum pin 86 frontward by pushing the switch lever 41A. Thus, the brake member 32 can be assuredly moved to the brake release position in conjunction with an operation on the switch lever 41A.

In Embodiment 3 described above, the connection plate is formed at the brake member and connected to the switch lever. However, an upward connection plate may be formed at the front end of the switch lever and fixed to the front surface of the brake member, or the brake member and the switch lever may be connected by an L-shaped member provided so as to extend between both members.

Moreover, in Embodiment 3 described above, the brake member is supported such that the brake member can be swung about the fulcrum pin frontward and rearward. However, even when such a swing fulcrum is not provided and the brake member is brought into a free state, it is possible to move the brake member to the brake release position in conjunction with a pushing operation on the switch lever.

Throughout the respective embodiments, the form of the lever member is also changeable as appropriate, and the shape of the lever member as well as the positional relationship between the fulcrum portion, the effort point portion, and the load point portion, etc., are also not limited to the above form.

Figure 11A:
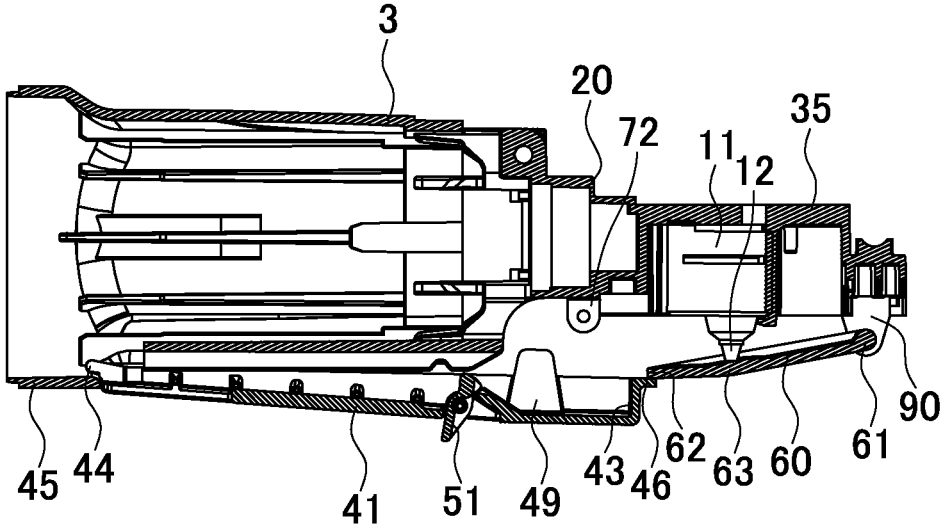
FIGS. 11A and 11B illustrate modification of a support structure for a lever member.
Figure 11B:
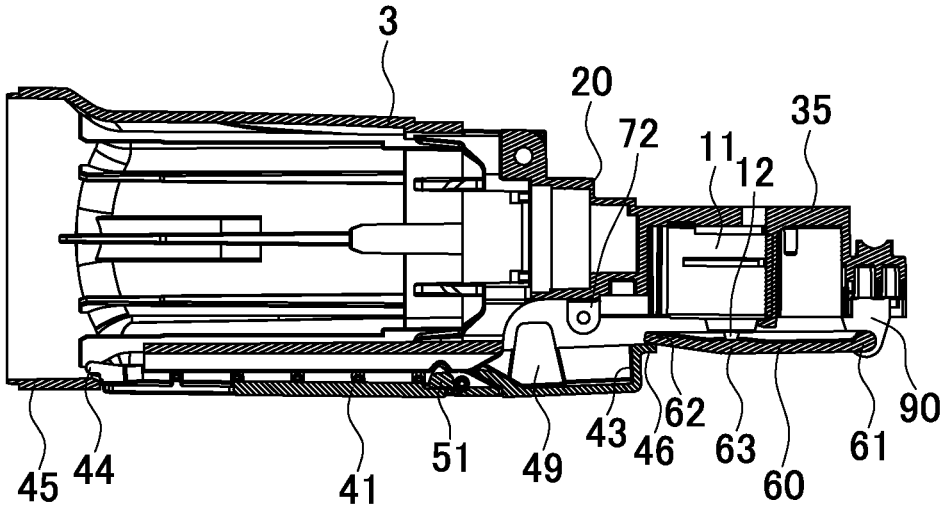

Moreover, the structure for the fulcrum portion is not limited to the structure in which the fulcrum portion is held by the rear cover. As shown in FIGS. 11A and 11B, a support rib 90 may be provided on the switch receiving portion 35 of the motor housing 3 so as to project downward, and the fulcrum portion 61 of the lever member 60 may be attached to the support rib 90 by a shaft. FIGS. 11A and 11B illustrate an example of Embodiment 1, but is also applicable to Embodiments 2 and 3.

When the fulcrum portion 61 is provided at the rear portion of the motor housing 3 as described above, the lever member 60 can be assembled to the motor housing 3 together with the switch 11 in advance, and it is easy to assemble the rear cover 6.

Moreover, also in the grinder, the location of the switch lever is not limited to the lower surface side of the housing, the switch lever may be provided at the upper surface side or the side surface side of the housing, the motor may be of a brushless type, or a battery pack may be attached as a power source to the rear end of the housing. As a matter of course, the respective inventions related to the lever member and the interlocking mechanism for the brake mechanism can be applied individually or in combination to an electric tool other than the grinder.

The invention claimed is:

1. An electric tool comprising:

a housing;

a motor housed in the housing;

a switch (i) housed in the housing and (ii) configured to drive the motor;

a switch lever (i) in an opening of the housing and (ii) configured to be moved by a user of the electric tool around a first pivot axis between an initial position at which the switch lever projects from the housing and a push-in position at which the switch lever is pushed toward the housing; and a lever member (i) rearward of the switch lever in a front-rear direction, (ii) housed in the housing such that the lever member cannot be directly operated by the user of the power tool and (iii) pivotable around a second pivot axis, wherein the first pivot axis and the second pivot axis are not co-axial, the switch is rearward of the switch lever, and the lever member is configured to interlock with operation of the switch lever such that (i) rotation of the switch lever around the first pivot axis causes rotation of the lever member around the second pivot axis and (ii) the lever member turns the switch ON when the switch lever is in the push-in position and (ii) turns the switch OFF when the switch lever is in the initial position.

2. The electric tool according to claim 1, wherein the lever member includes:

a fulcrum portion that is rotatably supported rearward of a plunger of the switch;

an effort point portion that is configured to interlock with the operation of the switch lever; and a load point portion that is between the fulcrum portion and the effort point portion and configured to press the plunger.

3. The electric tool according to claim 2, wherein the fulcrum portion is at a rearmost portion of the housing.

4. The electric tool according to claim 3, wherein the housing includes a motor housing that houses the motor and extends rearward, and the fulcrum portion is at a rear portion of the motor housing.

5. The electric tool according to claim 4, wherein
a switch receiving portion configured to hold the switch is integrally formed at the rear portion of the motor housing, and the fulcrum portion is at the switch receiving portion.

6. The electric tool according to claim 2, wherein
the housing includes a motor housing that houses the motor and extends rearward, and the fulcrum portion is at a rear portion of the motor housing.

7. The electric tool according to claim 6, wherein
a switch receiving portion configured to hold the switch is integrally formed at the rear portion of the motor housing, and the fulcrum portion is at the switch receiving portion.

8. The electric tool according to claim 2, wherein
the switch lever has a strip shape extending in a front-rear direction, a front end rotatably supported by the housing, and a rear end swingable between the initial position and the push-in position.

9. The electric tool according to claim 8, wherein
the lever member is a band-shaped plate extending in the front-rear direction, the lever member is rearward of the switch lever, the lever member has a rear end as the fulcrum portion and a front end as the effort portion, and the load point portion between the fulcrum portion and the effort point portion is in contact with the plunger at a projected position.

10. The electric tool according to claim 9, wherein
the lever member has the effort portion inside the rear end of the switch lever and is biased by the plunger to a rotation position at which the switch lever is at the initial position.

11. The electric tool according to claim 10, wherein
the switch lever and the lever member are on a lower surface of the housing, and the switch lever projects downward from the housing at the initial position.

12. The electric tool according to claim 1, wherein
a brake mechanism is in the housing and includes a brake member configured to be moved between a brake position at which an output shaft of the motor is braked at the initial position of the switch lever and a brake release position at which the braking of the output shaft is released at the push-in position of the switch lever.

13. An electric tool comprising:
a housing;
a motor housed in the housing;
a switch (i) housed in the housing and (ii) configured to drive the motor;
a switch lever in the housing and configured to be movable between an initial position at which the switch lever projects from the housing and a push-in position at which the switch lever is pushed to the housing side and turns ON the switch; and
a lever member rearward of the switch lever, wherein
the switch is rearward of the switch lever,
the lever member is configured to interlock with an operation of the switch lever (i) to turn the switch ON at the push-in position of the switch lever and (ii) to turn the switch OFF at the initial position of the switch lever, and
the lever member includes: a fulcrum portion that is rotatably supported rearward of a plunger of the switch; an effort point portion that is configured to interlock with the operation of the switch lever; and a load point portion that is between the fulcrum portion and the effort point portion and configured to press the plunger.

14. The electric tool according to claim 13, wherein
the fulcrum portion is at a rearmost portion of the housing.

15. The electric tool according to claim 14, wherein
the housing includes a motor housing that houses the motor and extends rearward, and the fulcrum portion is at a rear portion of the motor housing.

16. The electric tool according to claim 15, wherein
a switch receiving portion configured to hold the switch is integrally formed at the rear portion of the motor housing, and the fulcrum portion is at the switch receiving portion.

17. The electric tool according to claim 13, wherein
the housing includes a motor housing that houses the motor and extends rearward, and the fulcrum portion is at a rear portion of the motor housing.

18. The electric tool according to claim 17, wherein
a switch receiving portion configured to hold the switch is integrally formed at the rear portion of the motor housing, and the fulcrum portion is at the switch receiving portion.

19. The electric tool according to claim 13, wherein
the switch lever has a strip shape extending in a front-rear direction, a front end rotatably supported by the housing, and a rear end swingable between the initial position and the push-in position.

20. The electric tool according to claim 19, wherein
the lever member is a band-shaped plate extending in the front-rear direction, the lever member is rearward of the switch lever, the lever member has a rear end as the fulcrum portion and a front end as the effort portion, and the load point portion between the fulcrum portion and the effort point portion is in contact with the plunger at a projected position.

* * * * *